US008128458B2

(12) United States Patent
Saito et al.

(10) Patent No.: US 8,128,458 B2
(45) Date of Patent: Mar. 6, 2012

(54) POLISHING APPARATUS AND SUBSTRATE PROCESSING METHOD

(75) Inventors: Kenichiro Saito, Tokyo (JP); Akihiro Yazawa, Tokyo (JP); Masanori Sasaki, Tokyo (JP); Takashi Mitsuya, Tokyo (JP)

(73) Assignee: Ebara Corporation, Tokyo (JP)

( * ) Notice: Subject to any disclaimer, the term of this patent is extended or adjusted under 35 U.S.C. 154(b) by 853 days.

(21) Appl. No.: 11/631,417

(22) PCT Filed: Jul. 21, 2005

(86) PCT No.: PCT/JP2005/013784

§ 371 (c)(1),
(2), (4) Date: Sep. 4, 2008

(87) PCT Pub. No.: WO2006/009304

PCT Pub. Date: Jan. 26, 2006

(65) Prior Publication Data

US 2009/0209175 A1 Aug. 20, 2009

(30) Foreign Application Priority Data

Jul. 22, 2004 (JP) ..... 2004-214598

(51) Int. Cl.
*B24B 49/00* (2006.01)

(52) U.S. Cl. ..... 451/6; 451/8; 451/11; 451/41; 451/286

(58) Field of Classification Search ..... 451/6, 8, 451/11, 41, 285–290
See application file for complete search history.

(56) References Cited

U.S. PATENT DOCUMENTS

| | | | |
|---|---|---|---|
| 5,733,171 | A | 3/1998 | Allen et al. |
| 5,823,853 | A | 10/1998 | Bartels et al. |
| 5,993,289 | A | 11/1999 | Allen et al. |
| 6,293,846 | B1 | 9/2001 | Oguri |

FOREIGN PATENT DOCUMENTS

| | | | |
|---|---|---|---|
| EP | 0 885 691 | A2 | 12/1998 |
| JP | 2004-63589 | | 2/2004 |
| JP | 2004327519 | A * | 11/2004 |

* cited by examiner

*Primary Examiner* — Maurina Rachuba
(74) *Attorney, Agent, or Firm* — Wenderoth, Lind & Ponack, L.L.P.

(57) ABSTRACT

A polishing apparatus detects the escape of a substrate from a top ring during polishing. The polishing apparatus includes a polishing table having a polishing pad, a top ring, and a substrate escape detection section for detecting escape of the substrate from the top ring. The detection section includes a light irradiation member for irradiating an area of the upper surface of the polishing pad with light, a controller for controlling the light irradiation of the light irradiation member, an image-taking member for taking an image of the area irradiated with the light, and an information processing member for processing information outputted from the image-taking member. The controller controls the light irradiation member in such a manner that it performs light irradiation at least for a period of time during which the substrate is regarded as being in contact with the polishing pad.

7 Claims, 5 Drawing Sheets

POLISHING APPARATUS AND SUBSTRATE PROCESSING METHOD

TECHNICAL FIELD

The present invention relates to a polishing apparatus for polishing a substrate, such as a semiconductor wafer, and more particularly to a polishing apparatus provided with a substrate escape detection section for detecting escape of a substrate from a top ring during polishing. The present invention also relates to a substrate processing apparatus incorporating a polishing apparatus and to a method for detecting escape of a substrate from a top ring which can be employed in a polishing apparatus.

BACKGROUND ART

With the recent progress toward higher integration of semiconductor devices, the circuit interconnects are becoming finer and the distance between adjacent interconnects is becoming smaller. Especially, when forming a circuit pattern by optical lithography with a line width of not more than 0.5 μm, it requires that surfaces on which pattern images are to be focused by a stepper be as flat as possible because depth of focus of an optical system is relatively small. A polishing apparatus for carrying out chemical-mechanical polishing (CMP) is known as a means for flattening a surface of such a semiconductor wafer.

A common polishing apparatus is designed to polish a surface (polishing surface) of a substrate by bringing the surface of the substrate held by a top ring into contact with an upper surface of a polishing pad (polishing cloth) of a polishing table while rotating the polishing table and the top ring. In the polishing apparatus, the substrate rarely escapes from the top ring during polishing when the substrate has been received by the top ring in a normal manner. On the other hand, when the substrate is not received by the top ring in a normal manner and runs on a guide ring of the top ring, the substrate can escape from the top ring during polishing. If the substrate escapes from the top ring, the substrate will then revolve on the rotating polishing table and collide against the top ring, which may result in breakage of the substrate itself or damage to members of the polishing apparatus, such as the guide ring of the top ring, the polishing pad on the polishing table, and the like.

In order to deal with the substrate escape problem, a method has been employed in which a camera or the like is provided above a polishing pad to take an image of an upper surface of the polishing pad, and the image taken by the camera is processed to detect escape of a substrate from a top ring. Another conventional method involves provision of a light-emitting member for emitting light toward an upper surface of a polishing pad and a light-receiving member for receiving the reflected light of the light emitted from the light-emitting member. An amount of light received by the light-receiving member is measured to determine the presence or absence of a substrate on the light-irradiated polishing pad, thereby detecting escape of the substrate from a top ring. This method utilizes a difference in glossiness between the polishing pad and the surface of the substrate, and determines the presence or absence of the substrate on the light-irradiated polishing pad, i.e., detects escape of the substrate from the top ring, by detecting a change in the amount of light received by the light-receiving member.

In these days, copper having a higher electric conductivity than aluminum or an aluminum alloy is often used as a material for forming an interconnect circuit on a substrate. Copper is a corrosion-susceptible metal. Thus, processing of copper by CMP entails the problem of copper corrosion. Besides process environments, such as a slurry or a cleaning solution, a photoelectromotive force can also cause copper corrosion, the so-called photocorrosion. The photocorrosion phenomenon can occur when a copper layer formed on a substrate for the formation of interconnects is irradiated with light. Therefore, polishing of a substrate having a surface copper layer for interconnects may be carried out in a light-shielding dark room (see, for example, Japanese Patent Laid-Open Publication. No. 2004-63589).

SUMMARY OF THE INVENTION

As described above, photocorrosion of copper for interconnects can occur when the surface (polishing surface) of a substrate is irradiated with light. Therefore, in order to polish a substrate having a surface copper layer for interconnects while preventing photocorrosion of the copper, it is not preferable to employ the above-described methods involving image processing or reflected light detection for detection of escape of a substrate from a top ring.

The present invention has been made in view of the above situation in the background art. It is therefore an object of the present invention to provide a polishing apparatus which can detect escape of a substrate from a top ring without causing photocorrosion of, for example, a copper layer formed on the substrate for the formation of interconnects, and a substrate processing apparatus incorporating the polishing apparatus.

In order to achieve the object, the present invention provides a polishing apparatus comprising: a polishing table having a polishing pad; a top ring for holding a substrate and pressing the substrate against the polishing table; and a substrate escape detection section for detecting escape of the substrate from the top ring, including a light irradiation member for irradiating an area of an upper surface of the polishing pad with light, a controller for controlling the light irradiation of the light irradiation member, a light-receiving member for taking in a reflected light of the irradiating light or an image-taking member for taking an image of the area irradiated with the light, and an information processing member for processing information outputted from the light-receiving member or the image-taking member, wherein the controller controls the light irradiation member in such a manner that it performs light irradiation at least for a period of time during which the substrate is regarded as being in contact with the polishing pad.

The controller controls the light irradiation member in such a manner that it performs light irradiation at least for a period of time during which the substrate is regarded as being in contact with the polishing pad. This can minimize the substrate irradiation time, thereby preventing photocorrosion of, for example, copper. In addition, escape of the substrate from the top ring can be securely detected from the start to the end of polishing, thus preventing the occurrence of an accident such as breakage of the substrate. Further, since the light irradiation is performed while the substrate is regarded as being in contact with the polishing pad, the contact surface of the substrate with the polishing pad is not irradiated with the light. This can securely prevent photocorrosion of the contact surface.

In a preferred embodiment of the present invention, the controller regards the substrate as coming into contact with the polishing pad exactly when the top ring starts lowering or when a predetermined time has elapsed after the top ring has started lowering.

This can securely detect escape of the substrate from the top ring from shortly before contact of the substrate with the polishing pad, preventing the occurrence of an accident, such as breakage of the substrate.

In a preferred embodiment of the present invention, the controller regards the substrate as detaching from the top ring exactly when the top ring starts rising or when a predetermined time has elapsed after the top ring has started rising.

This can securely detect escape of the substrate from the top ring until shortly after detachment of the substrate from the top ring, preventing the occurrence of an accident, such as breakage of the substrate.

In a preferred embodiment of the present invention, the light irradiation member irradiates with light only an area, lying in the vicinity of the periphery of the top ring, of the upper surface of the polishing pad.

This can prevent a substrate, not escaping from the top ring, from being irradiated with light during polishing, thus preventing photocorrosion of the substrate.

A semiconductor wafer having a surface copper layer for interconnects, for example, may be used as the substrate.

Even when a semiconductor wafer having a surface copper layer, which is easy to corrode by light, is used as the substrate, photocorrosion of such copper layer can be effectively prevented by the present invention.

The present invention also provides a substrate processing apparatus comprising the above-described polishing apparatus and a housing having in its peripheral wall an observation window for observation of the inside and housing at least the polishing apparatus in a darkroom condition, wherein the observation window is provided with a light-shielding member for shielding against external light.

By housing the polishing apparatus in the housing in a darkroom condition and providing the observation window for inside observation with the light-shielding member for shielding against external light, the substrate can be prevented from being irradiated with external light during polishing, thus preventing photocorrosion of the substrate.

The light-shielding member is, for example, a light-shielding sheet attached to the observation window.

The present invention also provides a method for detecting escape of a substrate from a top ring, comprising: pressing a substrate held by a top ring against a polishing pad of a polishing table while moving the substrate and the polishing pad relative to each other; and irradiating an area of an upper surface of the polishing pad with light while the substrate is in contact with the polishing pad, either taking in a reflected light of the irradiating light or taking an image of the area irradiated with the light, and processing information on the light taken in or the image taken, thereby detecting escape of the substrate from the top ring.

The substrate escape detection method can minimize the time for irradiating a substrate with light to thereby prevent photocorrosion of the substrate and can securely detect escape of the substrate from a top ring from the start to the end of polishing to thereby prevent the occurrence of an accident, such as breakage of the substrate.

DETAILED DESCRIPTION OF THE INVENTION

Preferred embodiments of the present invention will now be described in detail with reference to the drawings.

Figure 1:
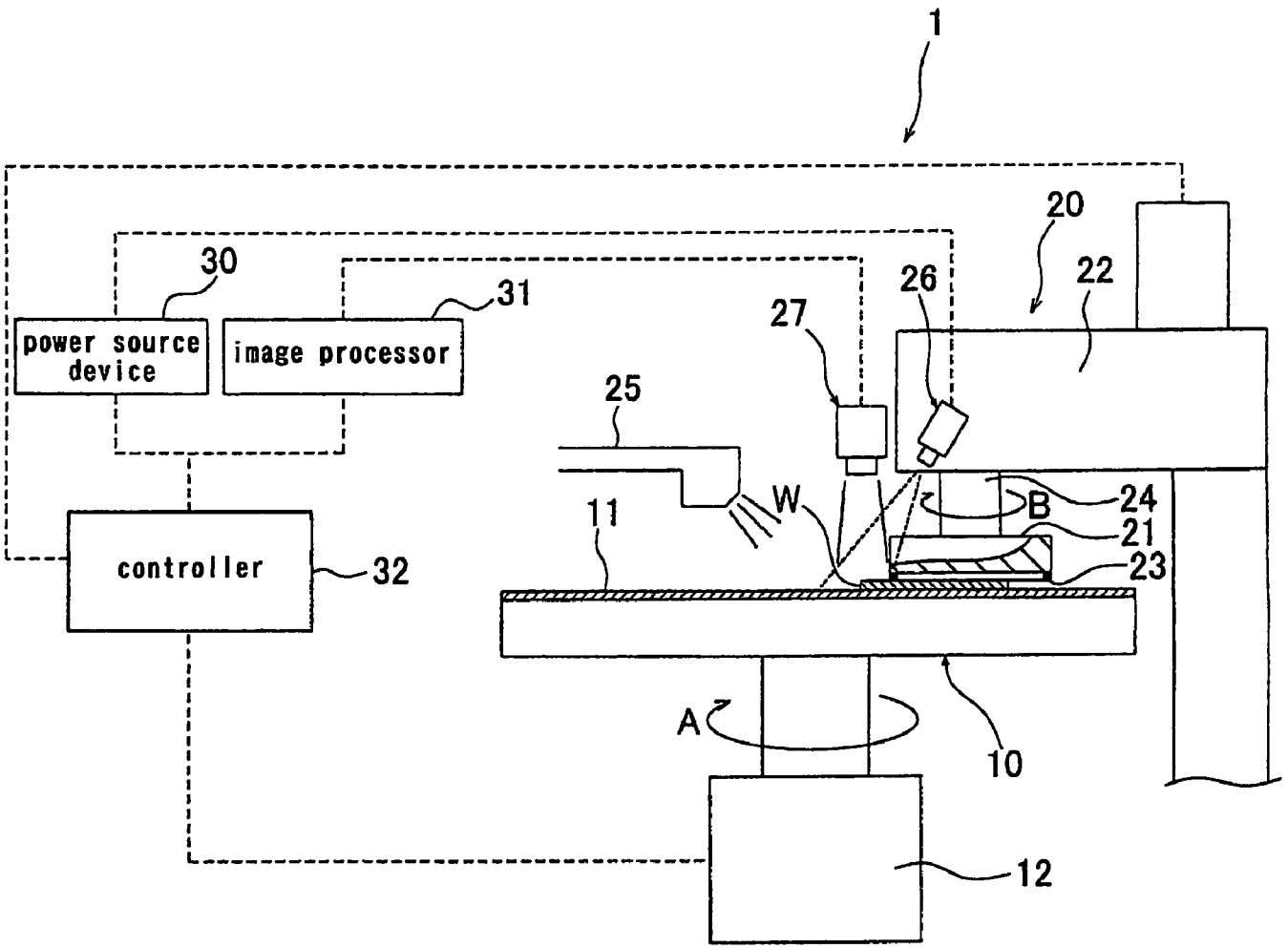
FIG. 1 is a schematic side view of a polishing apparatus according to an embodiment of the present invention.

FIG. 1 is a side view schematically showing the construction of a polishing apparatus according to an embodiment of the present invention. As shown in FIG. 1, the polishing apparatus 1 includes a polishing table 10 having a polishing pad 11 in the upper surface, and a top ring unit 20 including a top ring 21 for holding a semiconductor wafer (substrate) W as a polishing object, the wafer having a surface copper layer for interconnects, and for pressing the wafer W against the surface of the polishing pad 11 of the polishing table 10 to polish the wafer W. The polishing table 10 rotates in the direction of arrow A shown in FIG. 1 by a drive section 12, and the top ring 21 rotates in the direction of arrow B shown in FIG. 1 by a top ring shaft 24. Above the polishing table 10 is disposed an abrasive liquid nozzle 25 for supplying an abrasive liquid for polishing to the sliding surfaces of the wafer W and the polishing pad 11. The polishing apparatus 1 is disposed in a housing whose interior is kept in a darkroom condition, as will be described later, so that the wafer W is polished in the housing without being irradiated with external light.

Figure 2A:
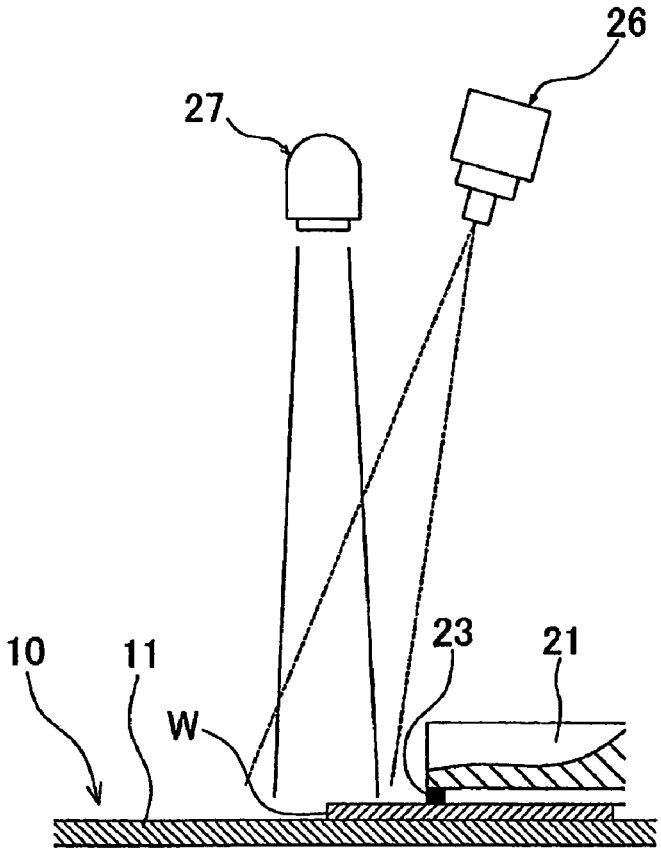
FIG. 2A is a schematic diagram illustrating the arrangement of an LED lighting device and a CCD camera.

The polishing apparatus 1 is provided with a substrate (wafer) escape detection section including a spot-type LED lighting device 26 as a light irradiation member for irradiating an area of the upper surface of the polishing pad 11 with light, and a CCD camera 27 as an image-taking member for taking an image of the area, irradiated with the light from the LED lighting device 26, of the upper surface of the polishing pad 11. FIG. 2A is an enlarged view of a portion of FIG. 1, showing the arrangement of the LED lighting device (light irradiation member) 26 and the CCD camera (image-taking member) 27. The LED lighting device 26 is installed above the polishing table 10 and oriented so that it can irradiate with a spot light an area, lying in the vicinity of the periphery of the top ring 21, of the upper surface of the polishing pad 11. The LED lighting device 26 is set at such a height from the polishing pad 11 that it can provide a sufficient amount of light for detecting, in an image taken by the CCD camera 27, the wafer W coming into a target range of the CCD camera 27, as will be described later. Though any color may be used for the irradiating LED light, it is preferred to use a relatively bright white LED light in order to take a sharp image with the CCD camera 27. Though other lighting devices than the LED lighting device 26 may also be employed as a light irradiation member, it is desirable to employ a long-life LED lighting device from the viewpoint of avoiding frequent changes of light sources.

Figure 2B:
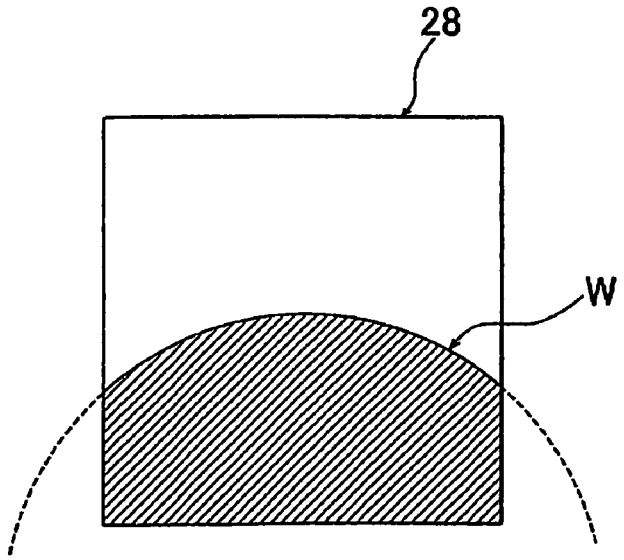
FIG. 2B is a diagram illustrating a target range of the CCD camera.

The CCD camera 27 is installed right above the LED light-irradiating area, lying in the vicinity of the periphery of the top ring 21, of the upper surface of the polishing pad 11, and at such a height position that escape of the wafer W from the top ring 21 can be detected in an image taken by using the LED lighting as the light source. FIG. 2B illustrates an example of the image target range 28 of the CCD camera 27. The CCD camera 27 is installed in a position at which it can catch in its target range 28 the wafer W escaping from the lower surface of the top ring 21, as shown in FIG. 2B, and take an image of the wafer W.

Turning back to FIG. 1, electric power from a power source device 30 is supplied to the LED lighting device 26. Image data taken by the CCD camera 27 is sent to an image processor (information processing member) 31 for image processing. The power source device 30 and the image processor 31 are controlled by a controller 32. The image information processed by the image processor 31 is inputted into the controller 32, and the controller 32 detects escape of the wafer W based on the image information. The controller 32 also controls the operations of the drive section 12 for rotating the polishing table 10 and a top ring arm 22 for pivoting and rotating the top ring 21.

In the operation of the polishing apparatus 1 having the above-described construction, the top ring 21 receives the wafer W from the below-described pusher 51*a* or 51*b* (see FIG. 4) in such a manner that the wafer W is fit into a guide ring 23 provided in the peripheral region of the lower surface of the top ring 21, and holds the wafer W by vacuum attraction. Thereafter, the top ring arm 22 is pivoted until the top ring 21 reaches a predetermined position above the polishing table 10, and the top ring 21 is then lowered so as to bring the surface (polishing surface) of the wafer W into contact with the upper surface of the polishing pad 11. The polishing table 10 is rotated in the direction of arrow A shown in FIG. 1 while the top ring 21 is rotated in the direction of arrow B shown in FIG. 1, thus causing relative movement. The surface of the wafer W is polished by the relative movement between the wafer W and the polishing pad 11. During the polishing, an abrasive liquid is supplied from the abrasive liquid nozzle 25 to the sliding surfaces of the wafer W and the polishing pad 11.

In the case where the wafer W is received by the top ring 21 from the pusher 51*a* or 51*b* in a normal manner, the wafer W is fit in the guide ring 23. Since the wafer W is kept guided by the guide ring 23 during polishing, there is no fear of the wafer W escaping out of the guide ring 23. On the other hand, in the case where the wafer W is not received in a normal manner and runs on the top ring 21, the top ring 21 can tilt upon polishing, and the wafer W can escape sideways from the top ring 21 and collide against a portion of the polishing apparatus 1, causing an accident such as breakage.

After completion of the polishing of wafer W, the top ring arm 22 is raised to retreat the wafer W, held by vacuum attraction of the top ring 21, to above the polishing pad 11. If, however, the holding of the wafer W by vacuum attraction of the top ring 21 is not in a normal condition for some reason, there is a case in which the wafer W cannot be raised and left on the polishing pad 11 when the top ring 21 is raised. In this case, the wafer W, remaining on the polishing pad 11, can escape sideways from the guide ring 23 due to the rotation of the polishing table 10 and collide against a portion of the polishing apparatus 1, causing an accident such as breakage.

In order to prevent such an accident, it is necessary to detect escape of the wafer W from the top ring 21 during polishing. A description will now be given of the procedure for detecting escape of a wafer W from the top ring 21 with the substrate (wafer) escape detection section. First, the controller 32 regards the wafer W as coming into contact with the polishing pad 11 exactly when a command to lower the top ring 21 is issued and the top ring 21 starts lowering, and the controller 32 turns on the LED lighting device 26 to start light irradiation. Alternatively, the controller 32 may regard the wafer W as coming into contact with the polishing pad 11 when a predetermined time has elapsed after the wafer W has started lowering, and turn on the LED lighting device 26 to start light irradiation. Thus, the LED light irradiation starts shortly before or almost simultaneously with the wafer W coming into contact with the polishing pad 11. The CCD camera 27 starts taking an image of the light-irradiated area in a continuous manner simultaneously with or after elapse of a predetermine time from the start of the light irradiation of the LED lighting device 26.

The controller 32 regards the wafer W as detaching from the polishing pad 11 exactly when a command to raise the top ring 21 is issued upon completion of polishing of the wafer W and the top ring 21 starts rising, and the controller 32 stops the image taking of the CCD camera 27. Alternatively, the controller 32 may regard the wafer W as detaching from the polishing pad 11 when a predetermined time has elapsed after the top ring 21 has started rising, and stop the image taking of the CCD camera 27. The light irradiation of the LED lighting device 26 is stopped simultaneously with or after elapse of a predetermined time from the stop of the image taking of the CCD cameral 27. In the case of stopping the light irradiation of the LED lighting device 26 simultaneously with the stop of the image taking of the CCD camera 27, there is a fear that the CCD camera 27 can take an image in a dark condition after the stop of light irradiation, and the controller 32 can misdetect escape of the wafer W based on the image. In order to prevent this, it is desirable to stop the light irradiation of the LED lighting device 26 after elapse of a predetermined time from the stop of the image taking of the CCD camera 27.

When the wafer W escapes out of the top ring 21 while the light irradiation and the image taking by the CCD camera 27 are carried out, and part of the wafer W comes within the target range 28 of the CCD camera 27, as shown in FIG. 2B, the image of the wafer W is taken by the CCD camera 27 and the image taken is inputted into the image processor 31 where it is processed. Based on the processing results, the controller 32 detects escape of the wafer W from the top ring 21, and immediately stops the rotations of the polishing table 10 and the top ring 21. If necessary, the top ring 21 may be raised. The polishing operation can thus be stopped before the wafer W escaped from the top ring 21 moves on the rotating polishing table 10 and collides against the top ring 21, thereby preventing breakage of the wafer W itself and damage to a device or member, such as the top ring 21.

The light irradiation of the LED lighting device 26 and the image taking of the CCD camera 27 are carried out at least for a period of time during which the wafer W is regarded as being in contact with the polishing pad 11. Thus, the light irradiation is started exactly when a command to lower the top ring 21 is issued and the top ring 21 starts lowering or when a predetermined time has elapsed thereafter, while the image taking of the CCD camera 27 is started simultaneously with or after elapse of a predetermined time from the start of the light irradiation. The image taking is stopped exactly when a command to raise the top ring 21 is issued and the top ring 21 starts rising or when a predetermined time has elapsed thereafter, while the light irradiation is stopped simultaneously with or after elapse of a predetermined time from the stop of the image taking.

The polishing apparatus 1 is disposed in an external light-shielding housing, and the interior lighting of the housing is out. Accordingly, there is no irradiation of the wafer W with an external light during polishing, whereby photocorrosion of the wafer. W can be prevented. In addition, the wafer W is irradiated with light from the LED lighting device 26 only for the short time period of from shortly before, during and until shortly after its contact with the polishing pad 11. This can minimize the influence of light irradiation on the surface of the wafer W and prevent its photocorrosion. Further, with the interior lighting of the housing is out, only the restricted area, in the vicinity of the periphery of the top ring 21, of the upper surface of the polishing pad 11 is irradiated with light. Thus, there is no fear of irradiation with light of the other portion of the polishing apparatus 1, a wafer W not being polished, a wafer W without escape from the top ring 21 during polishing, etc.

Further, irradiation with a spot light and detection of escape of the wafer W are started shortly before or almost simultaneously with contact of the wafer W with the polishing pad 11, and the spot light irradiation and the wafer escape detection are continued until the wafer W detaches from the polishing pad 11 or shortly thereafter. This makes it possible to securely detect escape of the wafer W from the top ring 21 and prevent an accident from the start to the end of polishing.

Figure 3:
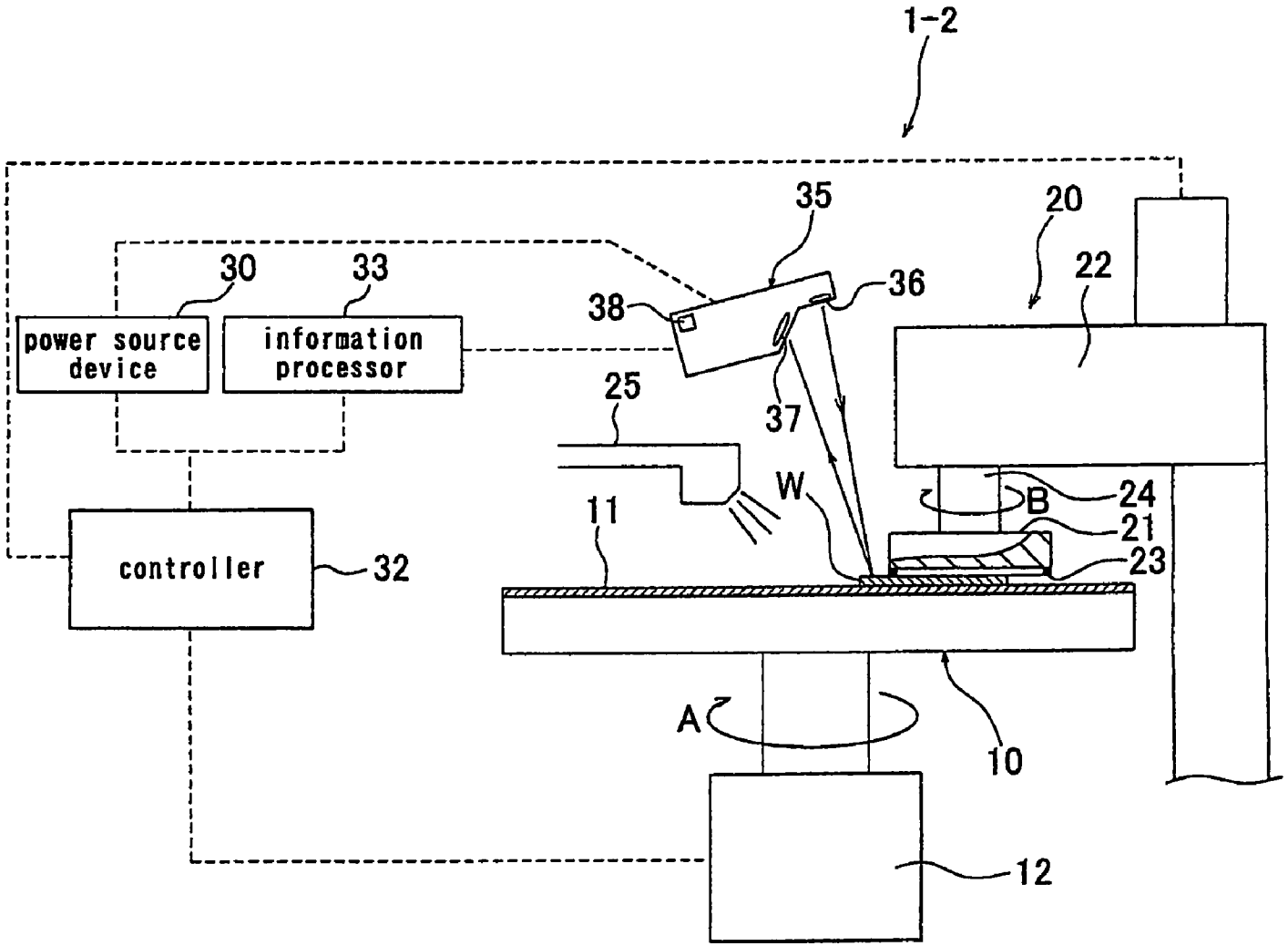
FIG. 3 is a schematic side view of a polishing apparatus according to another embodiment of the present invention.

FIG. 3 shows a polishing apparatus according to another embodiment of the present invention. In FIG. 3, the same members or components as those of the polishing apparatus 1 shown in FIG. 1 are given the same reference numerals, and a detailed description thereof is omitted. The polishing apparatus 1-2 shown in FIG. 3 includes a wafer sensor 35 and an information processor (information processing member) 33 instead of the LED lighting device 26, the CCD camera 27 and the image processor 31 of the polishing apparatus 1 shown in FIG. 1. The wafer sensor 35 includes a light-emitting member (light irradiation member) 36 for emitting light to the upper surface of the polishing pad 11, a light-receiving member 37 disposed below the light-emitting member 36, and a detection section 38 for detecting the presence of a wafer W based on an amount of light received by the light-receiving member 37. A visible laser having an emission wavelength in the range of 400-700 nm is preferably used for the wafer sensor 35. For example, a visible laser having an emission wavelength of 670 nm, belonging to JIS Class 2, may be used.

The wafer sensor 35 detects escape of the wafer W from the top ring 21 by utilizing the fact that the glossiness of the polishing pad 11 is relatively low whereas the glossiness of the surface of the wafer W is relatively high. In particular, the light-receiving member 37 receives a diffusely reflected light of the light emitted from the light-emitting member 36, and the amount of diffusely reflected light received by the light-receiving member 37 differs between the case where the emitted light impinges on the polishing pad 11 and the case where the emitted light impinges on the wafer W. Thus, the detection section 38 regards the wafer W as being in a normal position without escape from the top ring 21 when a predetermined amount of diffusely reflected light is received by the light-receiving member 37, whereas the detection section 38 regards the wafer W as escaping from the top ring 21 when the light-receiving member 37 does not receive the predetermined amount of diffusely reflected light.

Also in the polishing apparatus 1-2, the controller 32 regards the wafer W as coming into contact with the polishing pad 11 exactly when a command to lower the top ring 21 is issued and the top ring 21 starts lowering, and the controller 32 starts the emission of light from the light-emitting member 36. Alternatively, the controller 32 may regard the wafer W as coming into contact with the polishing pad 11 when a predetermined time has elapsed after the top ring 21 has started lowering, and starts the emission of light from the light-emitting member 36. Thus, the emission of light from the light-emitting member 36 and escape detection of the wafer W from the top ring 21 start shortly before or almost simultaneously with the wafer W coming into contact with the polishing pad 11. On the other hand, the controller 32 regards the wafer W as detaching from the polishing pad 11 exactly when a command to raise the top ring 21 is issued upon completion of polishing of the wafer W and the top ring 21 starts rising, and the controller 32 stops the emission of light from the light-emitting member 36. Alternatively, the controller 32 may regard the wafer W as detaching from the polishing pad 11 when a predetermined time has elapsed after the top ring 21 has started rising, and stop the emission of light from the light-emitting member 36.

Figure 4:
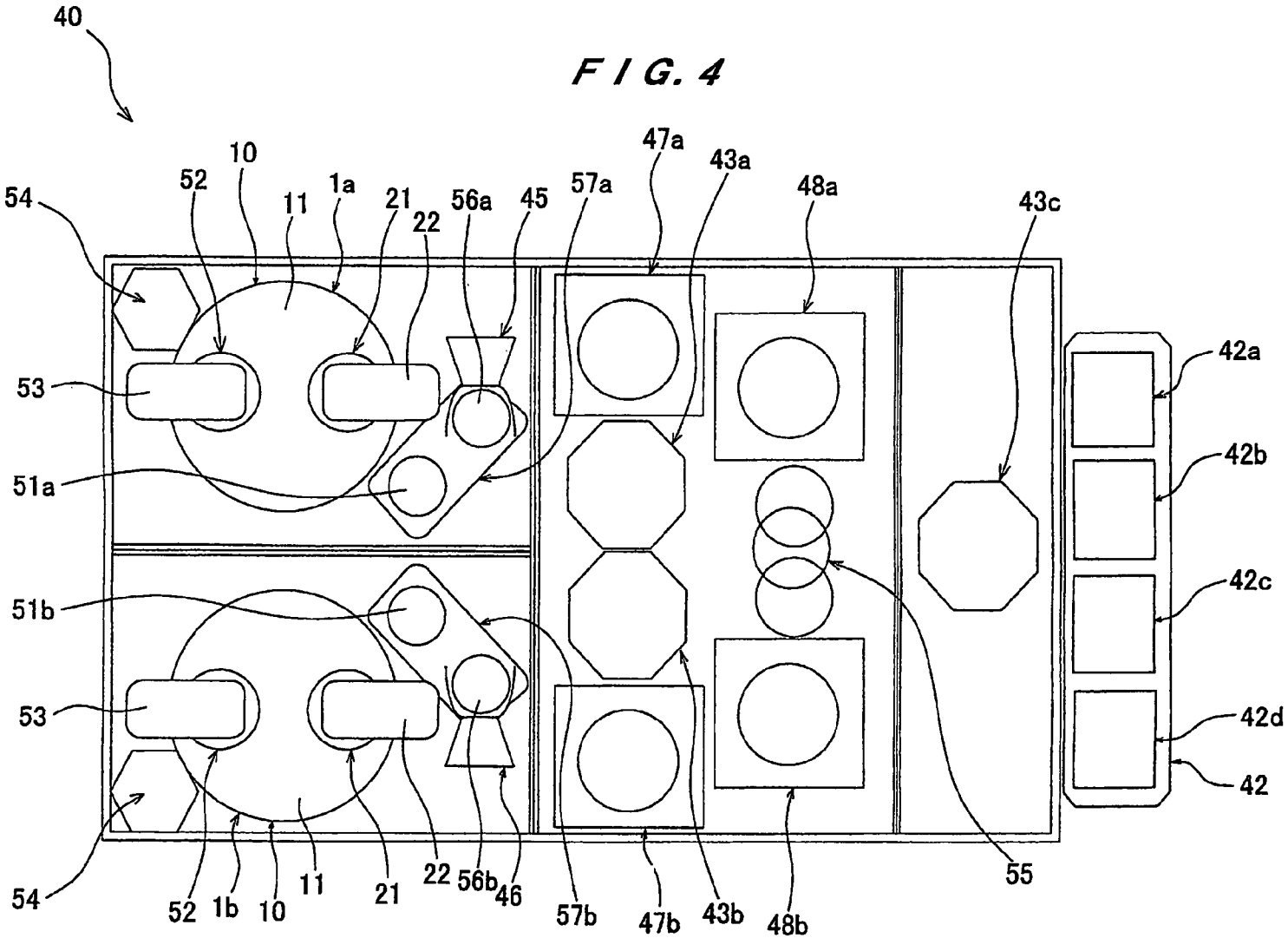
FIG. 4 is a schematic plan view of a substrate processing apparatus according to an embodiment of the present invention, which includes a polishing apparatus.

FIG. 4 is a schematic plan view showing a substrate processing apparatus including the above-described polishing apparatus 1 or 1-2. The substrate processing apparatus 40 includes, at its one end, a pair of polishing apparatuses 1*a*, 1*b* which are the above-described polishing apparatuses 1 or 1-2 and, at the other end, a loading/unloading unit 42 mounting cassettes 42*a*, 42*b*, 42*c*, 42*d* for housing wafers. Three transport devices 43*a*, 43*b*, 43*c* for transporting a wafer W are disposed between the polishing apparatuses 1*a*, 1*b* and the loading/unloading unit 42, and cleaning units 47*a*, 47*b*, 48*a*, 48*b* are disposed around the transport devices 43*a*, 43*b*, 43*c*.

In the vicinity of the polishing apparatuses 1*a*, 1*b* are installed reversing machines 45, 46, lifters 56*a*, 56*b* disposed below the reversing machines 45, 46, pushers 51*a*, 51*b* for transferring the wafer W between them and the top ring 21, and linear transporters 57*a*, 57*b* for transporting and transferring the wafer W between the lifters 56*a*, 56*b* and the pushers 51*a*, 51*b*. The pusher 51*a*, 51*b* receives an unpolished wafer W that has been transported through the reversing machine 45, 46 and the linear transporter 57*a*, 57*b* and delivers it to the top ring 21, and receives a polished wafer W from the top ring 21 and delivers it to the linear transporter 57*a*, 57*b*.

A dresser 52, which is provided for regenerating and dressing the surface of the polishing pad 11 which has been deteriorated through polishing, is disposed on the opposite side of the center of the polishing table 10 from the top ring 21. As with the above-described top ring 21, the dresser 52 is coupled to the lower end of a dresser shaft (not shown) suspended from the free end of a dresser arm 53. The dresser 52 can revolve by pivoting of the dresser arm 53, and moves between a dresser standby position 54 and the upper surface of the polishing table 10. A not-shown dressing member to rub the polishing pad 11 with it for dressing the polishing pad 11 is mounted to the lower surface of the dresser 52.

The transport devices 43*a*, 43*b*, 43*c* each have an articulate arm bendable in a horizontal plane. The three transport devices used in this embodiment each have its own charge. Thus, basically, the transport device 43*b* takes charge of the reversing machine 46 and the cleaning units 47*b*, 48*b* installed in the left region (lower region in FIG. 4) of the substrate processing apparatus 40. The transport device 43*a* takes charge of the reversing machine 45 and the cleaning units 47*a*, 48*a* installed in the right region (upper region in FIG. 4) of the substrate processing apparatus 40. The transport device 43*c* receives the wafer W from one of the cassettes 42*a*, 42*b*, 42*c*, 42*d* and delivers the wafer W to the cassette. The reversing machines 45, 46 are to turn the wafer W upside down, and are disposed in positions accessible by the transport devices 43*a*, 43*b*, respectively.

The cleaning units 47*a*, 47*b*, 48*a*, 48*b* may each be of any desired type. For instance, the cleaning units 47*a*, 47*b* on the polishing apparatuses 1*a*, 1*b* side brush the both surfaces of the wafer W by sponge rollers, and the cleaning units 48*a*, 48*b* on the cassettes 42*a*, 42*b*, 42*c*, 42*d* side clean the wafer W by supplying a cleaning liquid while clamping the edge of the wafer and rotating the wafer in a horizontal plane. The latter units also have a function as a centrifugal dryer. The cleaning units 47*a*, 47*b* may perform a primary cleaning of the wafer W, and the cleaning units 48*a*, 48*b* may perform a secondary cleaning of the wafer W after the primary cleaning.

Figure 5:
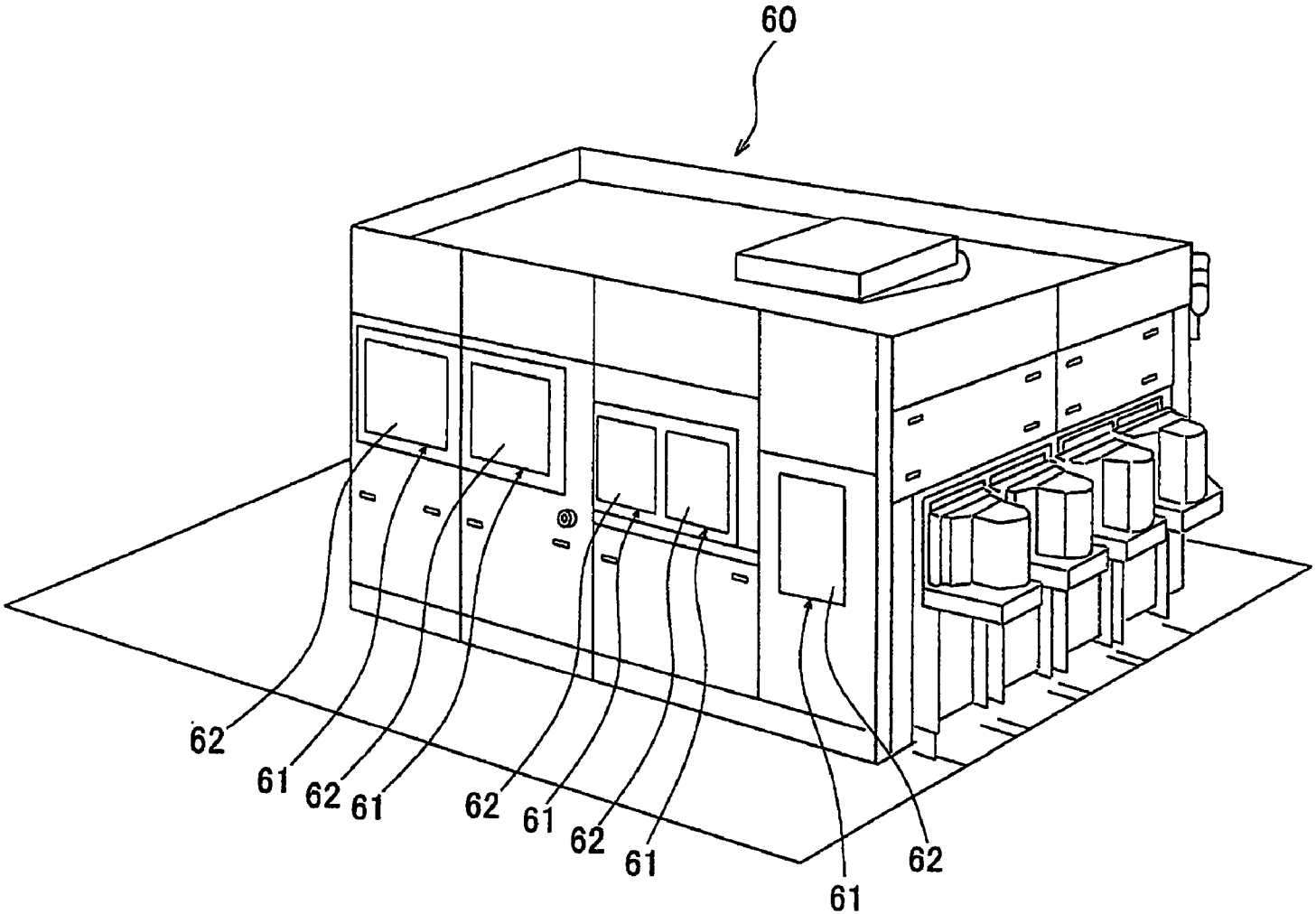
FIG. 5 is a schematic perspective view showing the exterior of a housing that houses the substrate processing apparatus therein.

FIG. 5 is a schematic perspective view showing the external construction of a housing 60 in which the substrate processing apparatus 40 is housed. The substrate processing apparatus 40 is housed within the housing 60 whose interior is kept in a darkroom condition, so that wafer processing is carried out in the darkroom condition. The housing 60 is provided with observation windows 61 for observation of the processing states in the various devices installed inside. An external light, passing through the observation windows 61 and reaching a wafer W, can cause photocorrosion of the wafer W. According to this embodiment, a light-shielding film 62 is attached to each observation window 61 as a light-shielding member for preventing the entrance of external light through the observation window 61.

The operation of the substrate processing apparatus 40 will now be described. First, a wafer W is taken by the transport device 43*c* out of one of the cassettes 42*a* to 42*d* and placed on a wafer temporary storage table 55. The transport device 43*a* (or 43*b*) receives the wafer W from the wafer temporary storage table 55 and transports it to the reversing machine 45 (or 46), where the wafer W is reversed. The lifter 56*a* (or 56*b*) receives the reversed wafer W and transfers it to the linear transporter 57*a* (or 57*b*). The linear transporter 57*a* (or 57*b*) moves horizontally and places the wafer W on the pusher 51*a* (or 51*b*). The top ring arm 22 is then pivoted to move the top ring 21 to above the pusher 51*a* (or 51*b*).

The top ring 21 receives the wafer W from the pusher 51*a* (or 51*b*) and, while holding the wafer W by vacuum attraction inside the guide ring 23, moves the wafer W from above the pusher 51*a* (or 51*b*) to a polishing position above the polishing table 10. The top ring 21 is then lowered to bring the wafer W into contact with the surface of the polishing pad 11 to carry out polishing of the wafer W in the manner described above. The vacuum attraction may be broken during polishing of the wafer W with the polishing pad 11. The wafer W after polishing is again moved to above the pusher 51*a* (or 51*b*) and placed on it and, via the linear transporter 57*a* (or 57*b*) and the lifter 56*a* (or 56*b*), is moved to the reversing machine 45 (or 46), where it is reversed. The reversed wafer W is transported by the transport device 43*a* (or 43*b*) to the cleaning unit 47*a* (or 47*b*), for example, having a function of cleaning the both wafer surfaces with roll sponges, where the both surfaces of the wafer W are cleaned.

Thereafter, the transport device 43*a* (or 43*b*) takes the cleaned wafer W out of the cleaning unit 47*a* (or 47*b*) and transports it to the cleaning unit 48*a* (or 48*b*), for example, having a function of cleaning the upper wafer surface with a pen-shaped sponge and spin-drying the wafer, where the wafer W is cleaned and dried. The wafer after cleaning is returned by the transport device 43*c* to the original cassette 42*a*, 42*b*, 42*c* or 42*d*.

Though a semiconductor wafer is used as a substrate to be polished in the above embodiments, a substrate usable as a polishing object in the present invention is, of course, not limited to a semiconductor wafer. Various types of polishing pads may be employed as the polishing pad 11. Examples of usable polishing pads include, besides a common polishing cloth, a fixed-abrasive pad impregnated with abrasive grains or an abrasive-free polishing pad, both having a relatively hard polishing surface which, if decayed, can self-regenerate.

While the present invention has been described with reference to the embodiments thereof, the present invention is not limited to the above embodiments, but various changes could be made to the embodiments within the technical concept of the present invention expressed by the claims, the specification and the drawings. Any construction, configuration or material not specifically referred to in the specification and the drawings should fall within the technical concept of the present invention insofar as it produces the technical effect of the present invention. For example, though the above-described substrate processing apparatus 40 has two parallel processing lines, it is possible to employ a single processing line.

Further, in addition to the above-described detection of escape of a wafer W from the top ring 21 shortly before, during and shortly after polishing according to the present invention, it is possible to detect or inspect the state of holding of the wafer W in the top ring 21 by using, for example, a not-shown vacuum measuring means when attaching or detaching the wafer W with the pusher 51*a*, 51*b* to or from the top ring 21 by applying or breaking vacuum attraction, or when moving or raising the top ring 21, holding the wafer W by vacuum attraction, from e.g. the pusher 51*a*, 51*b*, and to stop the operation when the wafer W is not held normally. This can detect a defective holding of the wafer W before polishing that could cause escape of the wafer W from the top ring 21 during polishing, and can prevent an accident due to possible escape of the wafer W from the top ring 21 during movement of the top ring 21 after polishing.

INDUSTRIAL APPLICABILITY

A polishing apparatus according to the present invention can detect escape of a substrate from a top ring without causing photocorrosion of a copper layer formed on the substrate for the formation of interconnects.

The invention claimed is:

1. A method for detecting escape of a substrate from a top ring, the method comprising:

holding a substrate with a top ring;

starting irradiating light by a light irradiation member when the top ring starts lowering or when a predetermined time has elapsed after the top ring has started lowering;

starting taking a continuous image of an area irradiated with the light and detecting the escape of the substrate from the top ring by processing information on the continuous image when a predetermined time has elapsed after the starting of the irradiating of the light by the light irradiation member;

performing polishing of the substrate by pressing the substrate held by the top ring against a polishing pad of a polishing table while moving the substrate and the polishing pad relative to each other;

after completion of the polishing of the substrate, stopping the taking of the continuous image and the detecting of the escape of the substrate from the top ring when the top ring starts rising or when a predetermined time has elapsed after the top ring has started rising; and stopping the irradiating of the light by the light irradiating member when a predetermined time has elapsed after the stopping of the taking of the continuous image.

2. A polishing apparatus comprising:

a polishing table having a polishing pad;

a top ring for holding a substrate and pressing the substrate against the polishing pad; and a substrate escape detection section for detecting escape of the substrate from the top ring, the substrate escape detection section including (i) a light irradiation member for irradiating light to an area of an upper surface of the polishing pad, (ii) a controller for controlling the light irradiated by the light irradiation member, (iii) an image-taking member for taking a continuous image of the area irradiated with the light, and (iv) an information processing member for processing information outputted from the image-taking member, wherein the controller controls the light irradiation member in such a manner that the light irradiation member starts the irradiating of the light when the top ring starts lowering before polishing of the substrate or when a predetermined time has elapsed after the top ring has started lowering, and stops the irradiating of the light when a predetermined time has elapsed after a stop of the taking of the continuous image by the image-taking member, and wherein the controller controls the image-taking member in such a manner that the image-taking member starts the taking of the continuous image of the area irradiated with the light when a predetermined time has elapsed after the start of the irradiating of the light by the light irradiation member, and stops the taking of the continuous image when the top ring starts rising after completion of the polishing of the substrate or when a predetermined time has elapsed after the top ring has started rising.

3. The polishing apparatus according to claim 2, wherein the light irradiation member irradiates with the light only the area of the upper surface of the polishing pad that is in the vicinity of a periphery of the top ring.

4. A substrate processing apparatus comprising:

the polishing apparatus according to claim 2; and a housing having in its peripheral wall an observation window for observation of inside the housing and housing at least the polishing apparatus in a darkroom condition, wherein the observation window is provided with a light-shielding member for shielding against external light.

5. The substrate processing apparatus according to claim 4, wherein the light-shielding member is a light-shielding sheet attached to the observation window.

6. A substrate processing apparatus comprising:

the polishing apparatus according to claim 3; and a housing having in its peripheral wall an observation window for observation of inside the housing and housing at least the polishing apparatus in a darkroom condition;

wherein the observation window is provided with a light-shielding member for shielding against external light.

7. The substrate processing apparatus according to claim 6, wherein the light-shielding member is a light-shielding sheet attached to the observation window.

* * * * *